US008259040B2

(12) United States Patent
Ryu et al.

(10) Patent No.: US 8,259,040 B2
(45) Date of Patent: Sep. 4, 2012

(54) ORGANIC LIGHT EMITTING DISPLAY AND DRIVING METHOD THEREOF

(75) Inventors: Do-Hyung Ryu, Suwon-si (KR); Do-Ik Kim, Suwon-si (KR)

(73) Assignee: Samsung Mobile Display Co., Ltd., Gyeonggi-Do (KR)

( * ) Notice: Subject to any disclaimer, the term of this patent is extended or adjusted under 35 U.S.C. 154(b) by 1184 days.

(21) Appl. No.: 12/082,118

(22) Filed: Apr. 8, 2008

(65) Prior Publication Data

US 2008/0266215 A1 Oct. 30, 2008

(30) Foreign Application Priority Data

Apr. 10, 2007 (KR) ..... 10-2007-0035006

(51) Int. Cl.
*G09G 3/30* (2006.01)

(52) U.S. Cl. ..... 345/76; 345/77; 345/211; 345/212; 345/691

(58) Field of Classification Search ..... 345/76, 345/36, 45
See application file for complete search history.

(56) References Cited

U.S. PATENT DOCUMENTS

2006/0001632 A1* 1/2006 Katagawa ..... 345/98
2006/0221015 A1* 10/2006 Shirasaki et al. ..... 345/77

FOREIGN PATENT DOCUMENTS

KR 10-1999-0024908 4/1999

OTHER PUBLICATIONS

Office Action issued by the Korean Patent Office on Jun. 25, 2008 in Korean Patent Application No. 10-2007-0035006.

* cited by examiner

*Primary Examiner* — Kevin M Nguyen
*Assistant Examiner* — Kenneth B Lee, Jr.
(74) *Attorney, Agent, or Firm* — Knobbe Martens Olson & Bear LLP

(57) ABSTRACT

Disclosed is an organic light emitting display of improved an image quality. The organic light emitting display includes a frame memory for storing a data to correspond to a write clock and outputting the data stored according to a read clock; a signal generation unit for supplying the read clock; a data driver for converting the data, supplied from the frame memory, into a data signal and supplying the converted data signal to data lines; a scan driver for supplying a scan signal to scan lines; and pixels arranged near crossing points between the scan lines and the data lines, wherein the read clock has a higher frequency than the write clock.

14 Claims, 5 Drawing Sheets

| Scan Line | 0 | 1H | 2H | 3H | 4H | 5H | 6H | 7H | 8H | 9H | 10H | 11H | 12H | 13H | 14H | 15H | 16H | 17H | 18H | 19H | ··· 3199H |
|---|---|---|---|---|---|---|---|---|---|---|---|---|---|---|---|---|---|---|---|---|---|
| 0 | D1 | | | | | | | | | | | | | | | | | | | | ··· |
| 1 | | | | | | | | | | | D1 | | | | | | | | | | ··· |
| ⋮ | | | | | | | | | | | | | | | | | | | | | ··· |
| 36 | | | | | | | | | D5 | | | | | | | | | | | | ··· |
| 37 | | | | | | | | | | | | | | | | | | | D5 | | ··· |
| ⋮ | | | | | | | | | | | | | | | | | | | | | |
| 106 | | | | | D6 | | | | | | | | | | | | | | | | ··· |
| 107 | | | | | | | | | | | | | | | D6 | | | | | | ··· |
| ⋮ | | | | | | | | | | | | | | | | | | | | | |
| 177 | | | | | | | | | | D7-2 | | | | | | | | | | | ··· |
| 178 | | | | | | | | | | | | | | | | | | | | D7-2 | ··· |
| ⋮ | | | | | | | | | | | | | | | | | | | | | |
| 247 | | | | | | | D7-1 | | | | | | | | | | | | | | ··· |
| 248 | | | | | | | | | | | | | | | | | D7-1 | | | | ··· |
| ⋮ | | | | | | | | | | | | | | | | | | | | | |
| 286 | | B | | | | | | | | | | | | | | | | | | | ··· |
| 287 | | | | | | | | | | | | B | | | | | | | | | ··· |
| ⋮ | | | | | | | | | | | | | | | | | | | | | |
| 304 | | | | | | D4 | | | | | | | | | | | | | | | ··· |
| 305 | | | | | | | | | | | | | | | | D4 | | | | | ··· |
| ⋮ | | | | | | | | | | | | | | | | | | | | | |
| 313 | | | | | | | | D3 | | | | | | | | | | | | | ··· |
| 314 | | | | | | | | | | | | | | | | | | D3 | | | ··· |
| ⋮ | | | | | | | | | | | | | | | | | | | | | |
| 317 | | | | D2 | | | | | | | | | | | | | | | | | ··· |
| 318 | | | D0 | | | | | | | | | | | D2 | | | | | | | ··· |
| 319 | | | | | | | | | | | | | D0 | | | | | | | | ··· |

ORGANIC LIGHT EMITTING DISPLAY AND DRIVING METHOD THEREOF

CROSS-REFERENCE TO RELATED APPLICATIONS

This application claims the benefit of Korean Patent Application No. 10-2007-0035006, filed on Apr. 10, 2007, in the Korean Intellectual Property Office, the disclosure of which is incorporated herein by reference.

BACKGROUND

1. Field

The present invention relates to an organic light emitting display and a driving method thereof, and more particularly to an organic light emitting display capable of improving an image quality, and a driving method thereof.

2. Discussion of Related Technology

In recent years, a variety of flat panel displays with reduced weight and volume when compared to a cathode ray tube have been developed. Flat panel displays can take the form of a liquid crystal display (LCD), a field emission display (FED), a plasma display panel (PDP), an organic light emitting display (OLED), as well as others.

The organic light emitting display uses organic light emitting diodes to display an image, the organic light emitting diodes generate the light through recombination of electrons and holes. Such an organic light emitting display has an advantage that it has a rapid response time and also it is driven with low power consumption.

Conventional pixels of the organic light emitting display generally display an image by charging a predetermined voltage in a storage capacity (Cst) included in each of the pixels, and supplying an electric current corresponding to the charged voltage to an organic light emitting diode. The pixels are driven in an analog mode, but the above-mentioned driving mode has a limitation for displaying a plurality of grey levels. A fixed voltage that will be stored in the storage capacity (Cst) is used to display the grey levels for all pixels, As a result, the general organic light emitting display has difficulty in displaying a uniform image because of the deviation in the threshold voltage and mobility of a drive transistor in each of the pixels.

SUMMARY OF CERTAIN INVENTIVE ASPECTS

One aspect is an organic light emitting display, including a frame memory configured to store data according to a write clock and to read the stored data according to a read clock, a signal generation unit configured to supply the read clock to the frame memory, a data driver configured to convert the data read from the frame memory into a data signal and to supply the converted data signal to data lines, a scan driver configured to supply a scan signal to scan lines, and a plurality of pixels arranged near crossing points of the scan lines and the data lines, where the read clock has a higher frequency than the write clock.

Another aspect is a method of driving an organic light emitting display. The method includes storing data in a frame memory according to a write clock, reading the data stored in the frame memory according to a read clock having a higher frequency than the write clock, converting the extracted data into a data signal, and supplying the data signal to pixels to generate light having a luminance corresponding to the data signal.

Another aspect is an organic light emitting display, including a data driver configured to supply data to data lines, a scan driver configured to supply a scan signal to scan lines, and a plurality of pixels associated with each of the scan lines, where the scan driver and the data driver are cooperatively configured to supply data to the pixels associated with each of the scan lines, where the data for a first scan line is only partially supplied to the first scan line when data for a second scan line begins to be supplied to the second scan line.

BRIEF DESCRIPTION OF THE DRAWINGS

These and/or other features of the invention will become apparent and more readily appreciated from the following description of certain exemplary embodiments, taken in conjunction with the accompanying drawings of which.

DETAILED DESCRIPTION OF CERTAIN INVENTIVE EMBODIMENTS

Figure 1:
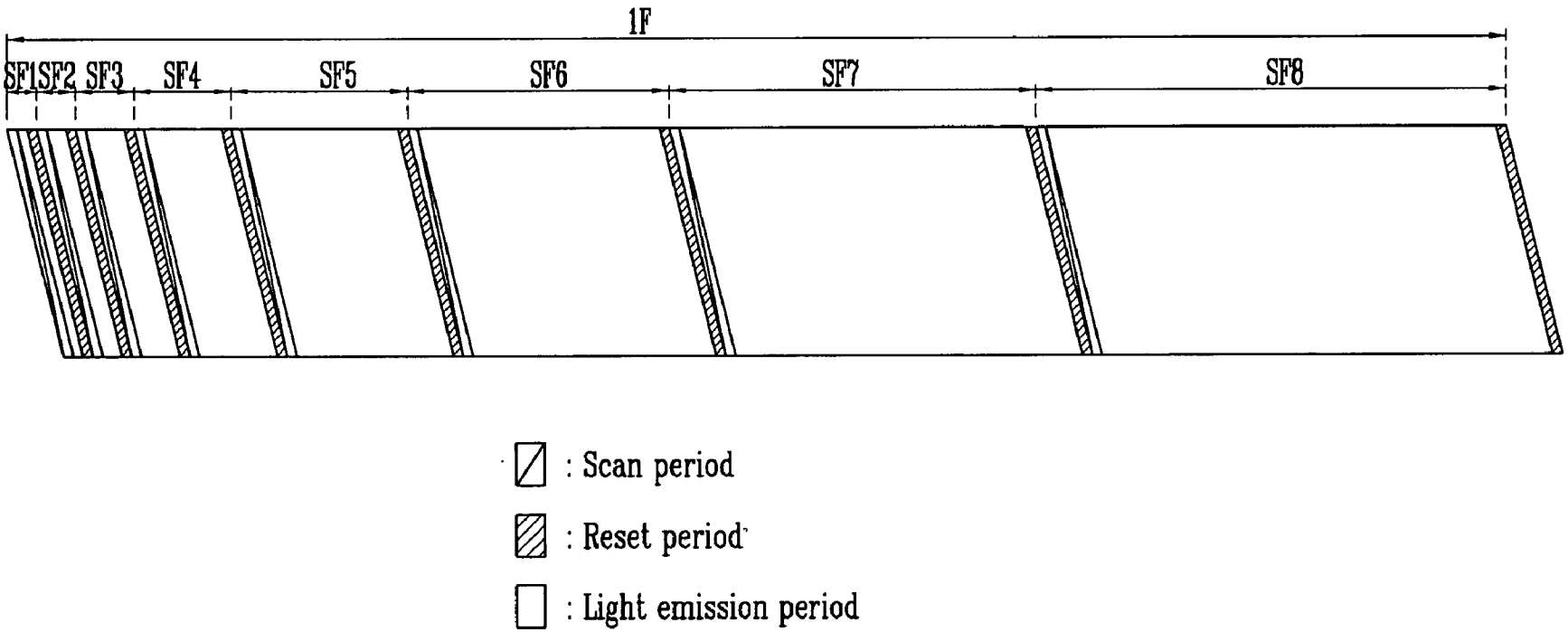
FIG. 1 is a diagram showing a general digital driving mode.

Hereinafter, certain exemplary embodiments will be described with reference to the accompanying drawings. Herein, when a first element is described as being coupled to a second element, the first element may be directly coupled to the second element but may also be indirectly coupled to the second element via a third element. Also, like reference numerals generally refer to like elements throughout.

FIG. 1 is a diagram showing one frame of a general digital driving mode.

Referring to FIG. 1, the digital driving mode divides one frame (1F) into a plurality of subframes (SF1 to SF8) and drives the subframes (SF1 to SF8). Here, each of the subframes is driven during a scan period for sequentially supplying a scan signal; a light emission period for allowing selected pixels to emit light; and a reset period when the pixels are driven to a non-light emission state.

A scan signal is sequentially supplied to scan lines during the scan period. And, a first data signal or a second data signal are supplied to data lines (D1 to Dm) synchronized with the scan signal. Accordingly, pixels selected by the scan signal each receive the first data signal or the second data signal.

During the light emission period, the pixels are allowed to emit the light or not to emit the light according to the first data signal or the second data signal supplied during the scan period. The pixels receiving the first data signal during the scan period is set to a light emission state during the light emission period, and the pixels receiving the second data signal during the scan period is set to a non-light emission state during the light emission period.

The light emission period is different for each of the subframes (SF1 SF8). For example, the light emission period is increased at a rate of $2^n$ (n=0, 1, 2, 3, 4, 5, 6, 7) in each of 8 subfields (SF1 to SF8). That is to say, the light emission time of the pixels is used to display grey levels in the digital driving mode. The pixels are converted into a non-light emission state during the reset period.

In this digital driving mode, the organic light emitting display may display an image having a uniform luminance regardless of non-uniformity in the drive transistor parameters since the ON or OFF state of the drive transistor in each of the pixels is used to display grey levels. Also, the organic light emitting display has an advantage that an ability to display grey levels is improved since the time is shared to display the grey level.

However, in the digital driving mode as shown in FIG. 1, a problem is that a difference in the light emission time between the subframes may cause a contour noise. Also, the light emission time of the pixels may be shortened since a scan signal is supplied to all of the scan lines during the scan period of the subframes in the digital driving mode.

Figure 2:
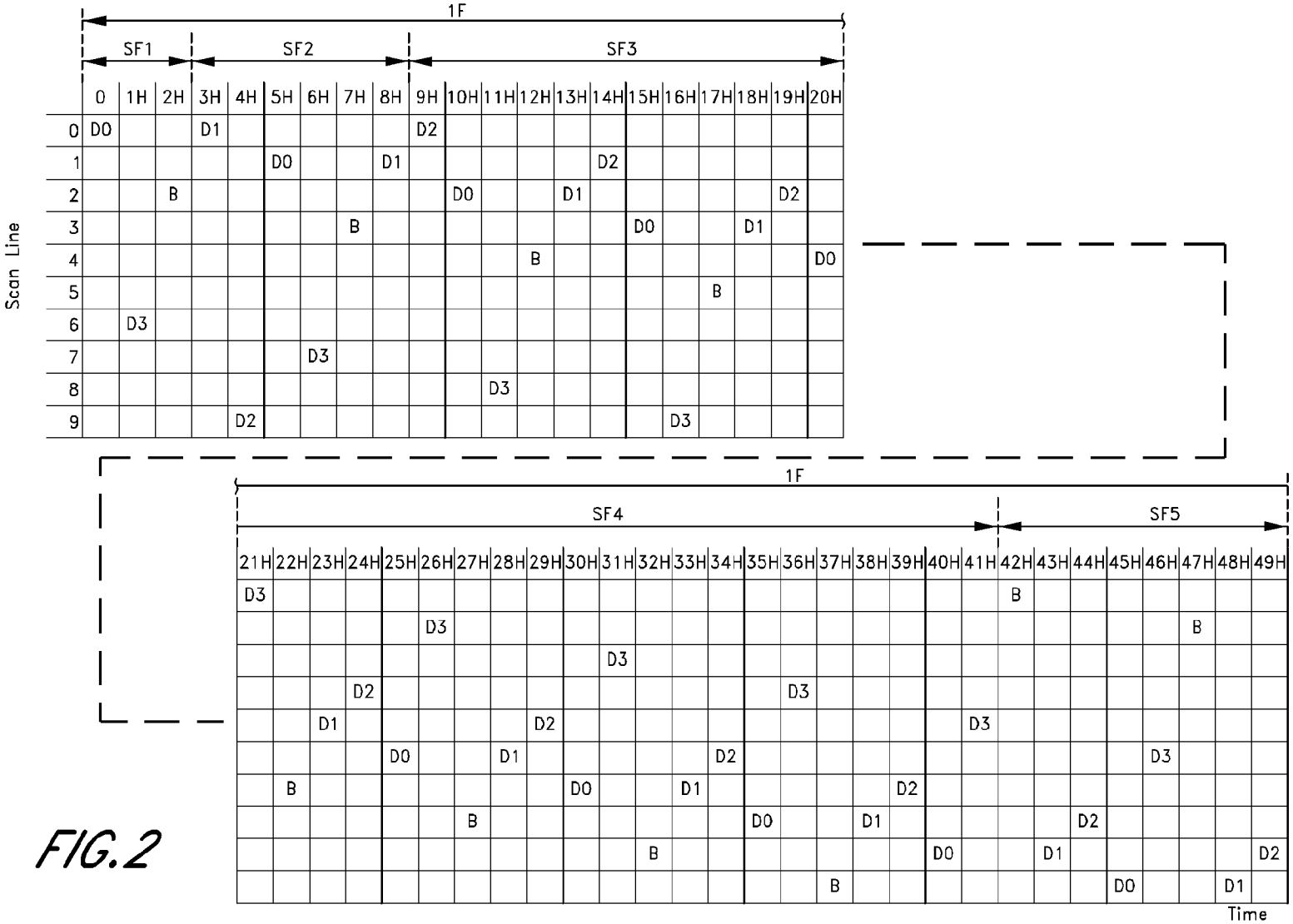
FIG. 2 is a diagram showing a digital driving mode according to one embodiment.

FIG. 2 is a diagram showing one frame according to one embodiment. Regarding FIG. 2, a data (Data) has 4 bits and one panel includes 10 scan lines.

Referring to FIG. 2, one frame is divided into 5 subframes. The one frame has 5 subframes including four subframes (SF1 to SF4) contributing to emitting the light according to the 4-bit data; and one subframe (SF5) set to a non-light emission state.

Here, the time of one frame is shared into a period of 50H by multiplying the number of scan lines by 5 subframes.

TABLE 1

| | D0 (SF1) | D1 (SF2) | D2 (SF3) | D3 (SF4) | B (SF5) |
|---|---|---|---|---|---|
| Starting point | 0 | 3 | 9 | 21 | 42 |
| Light emission time | 3H | 6H | 12H | 21H | 8H |
| Remainder | 0 | 3 | 4 | 1 | 2 |
| Line number | 0 | 0 | 9 | 6 | 2 |

In Table 1, D0, D1, D2 and D3 represent positions by bit in one data (Data). That is to say, D0 represents an LSB bit of the data (Data), and D3 represents an MSB bit of the data (Data). In this case, the LSB bit determines whether to emit the light during a period of a first subframe (SF1) having the lowest weight, or duration, and the MSB bit determines whether to emit the light during a period of a fourth subframe (SF4) having the highest weight.

The starting point represents a time where a subframe starts among times divided by 50H. And, the light emission time represents a light emission time of a corresponding frame. And, the remainder represents the rest obtained by dividing the starting point by the number of subframes.

Referring to Table 1 and FIG. 2, in order to substantially linearly display grey levels of each of the bits of the data (Data), a light emission time of the subframes should be doubled. First, the first subframe (SF1) emits the light during a period of 3H. Here, if the starting point of the first subframe (SF1) is set to a value of "0", then the second subframe (SF2) starts at a time of 3H among the periods of one frame and emits the light during a 6H period.

Also, a third subframe (SF3) starts at a time of 9H among the periods of one frame and emits the light during a 12H period. And, a fourth subframe (SF4) starts at a time of 21H and emits the light during a 21H period. And, a fifth subframe (SF4) as a blank frame starts at a time of 42H among the periods of one frame and emits the light during an 8H period.

Here, in order to substantially linearly display grey levels, the fourth subframe (SF4) emits the light during the 24H period, but is set to emit the light during a 21H period, as listed in Table 1. In one embodiment, if the starting point of a fifth subframe (SF5) is set to 45H, then a light emission period of the fourth subframe (SF4) is set to 24H, to display linear grey levels. However, if the starting point of the fifth subframe (SF5) is set to 45H, then the remainder (45/5) is set to a value of 0. In this case, the remainder of the first subframe (SF1) is identical to the remainder of the fifth subframe (SF5).

If the remainders of the first subframe (SF1) and the fifth subframe (SF5) are identical to each other as described above, the data may be supplied at the same. In some embodiments, the pixels are allowed to emit the light while dividing one frame by 50H periods and supplying one scan line to every 1H period, as shown in FIG. 2. Accordingly, if the remainders of the subframes in one frame are identical to each other, then a scan signal may be supplied to two scan lines during a certain 1H period.

Meanwhile, if the starting point of the fifth subframe (SF5) is set to 44H, then the remainder is set to the same value as the third subframe (SF3). And, if the starting point of the fifth subframe (SF5) is set to 43H, the remainder is set to the same value as the second subframe (SF2). Accordingly, the remainder of the fifth subframe (SF5) can be set to a different value from the remainders of the other subframes (SF1 to SF4) by setting the starting point of the fifth subframe (SF5) to 42H. As a result, the light emission time of the subframe (SF1) corresponding to the LSB bit is always set to an odd number (3H in Table 1). The remainder of the subframe (SF1) may be set so that it cannot be overlapped with the remainders of the subframes (SF1 to SF5) if the light emission time of the subframe (SF1) corresponding to the LSB bit is set to the odd number.

The light emission time of the blank frame (SF5) is determined by the following Equation 1.

$$\text{Light emission time of Blank subframe} = \text{One frame time} - LSB \text{ light emission time} \times (2^n - 1) \qquad \text{Equation 1}$$

In the Equation 1, n represents a bit number of a data (Data). In the Table 1 and FIG. 2, one frame time is set to 50H, an LSB light emission time is set to 3H. In this case, a light emission time of the blank subframe is set to 5H. However, in the Table 1, the light emission time of the blank subframe is set to 8H. That is to say, a predetermined error in the time calculated from the Equation 1 may appear since the starting point of the blank subframe is controlled so that the remainders cannot be overlapped with each other. In this case, the starting point of the blank subframe is controlled so that the light emission time of the blank subframe can be included within the range less than the light emission time of the LSB bit in the time calculated from the Equation 1. Accordingly, the LSB emission time is controlled within the range of 5H+3H.

Through the above-mentioned procedure, the starting point and the light emission time of each of the subframes (SF1 to SF5) are determined, and the line number is then calculated from the Equation 2. Here, the line number represents the number of scan lines receiving a scan signal.

$$\text{Line No.} = INT\{[(\text{One frame time} - \text{Starting point of Each bit})/\text{No. of Subframe}]+1\} \qquad \text{Equation 2}$$

In the Equation 2, one frame time is set to 50H, the number of subframes is set to 5. And, the starting point of the LSB bit (D0) is set to "1." Here, the frame time is set to 50H (That is to say, it is not 49H), and therefore the starting point of the LSB bit (D0) is also set to "1" rather than "0." In the Equation 2, the line number of the LSB bit (D0) is calculated as 10. Here, the scan lines are set as a $0^{th}$ scan line (S0) to a ninth scan line (S9), and therefore a line number of the tenth scan line is reset to 0. That is to say, the same line number as the number of the scan lines is reset to 0 when the line number is calculated using the Equation 2.

Figures 3, 4:
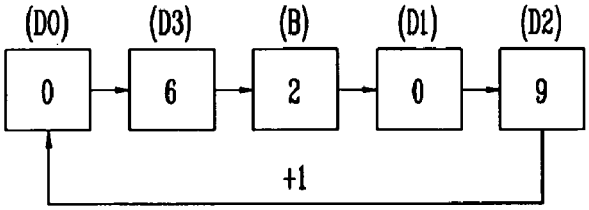
FIG. 3 is a diagram showing the increase in the line number in a driving mode as shown in FIG. 2.
FIG. 4 is a diagram showing a digital driving mode according to another embodiment.

In the same manner, a line number of a D1 bit is calculated as 10 through the Equation 2, and therefore reset to 0. And, line numbers of a D2 bit and a D3 bit are calculated as 9 and 6 through the Equation 2, respectively. Also, a line number of the blank frame (SF5) is calculated as 2 from the Equation 2. The line number calculated from the Equation 2 as described above are arranged in order of the size of the remainders, that is, arranged in order of 0→6→2→0→9, as shown in FIG. 3. (the size of the remainders is set in order of the first subframe (SF1), the fourth subframe (SF4), the fifth subframe (SF5), the second subframe (SF2) and the third subframe (SF3).) Here, the weight of the data signal is arranged in order of the remainder in the same manner as in the line number.

In this embodiment, a scan signal is supplied in order of the $0^{th}$ scan line (S0), the sixth scan line (S6), the second scan line (S2), the $0^{th}$ scan line (S0) and the ninth scan line (S9) according to the line number. And, a data signal is supplied when the scan signal is supplied. The order of the remainders of the Table 1 is of increasing weight. Therefore, a data signal having the weight of D0 bit is supplied when a scan signal is supplied to the $0^{th}$ scan line (S0). Accordingly, when the scan signal is supplied to the $0^{th}$ scan line (S0), the pixels receiving the data signal are allowed to emit the light during a 3H period.

Similarly, a data signal having the weight of D3 bit is supplied when a scan signal is supplied to a sixth scan line (S6), and the pixels are allowed to emit the light during a 21H period. In the same manner, data signals having the weights of blank, D1 bit, and D2 bit are supplied when a scan signal is supplied to the second scan line (S2), the $0^{th}$ scan line (S0) and the ninth scan line (S9), respectively.

After the scan signal is supplied to line numbers of the scan lines, the line numbers are increased by 1. Accordingly, the line numbers are then arranged in order of 1→7→3→1→10. In this case, the line numbers are determined in order of 1→7→3→1→0 since the line number 10 is reset to 0, and a scan signal is supplied to the scan lines according to the determined line number. The above-mentioned procedure is repeated as many as the number of the scan lines (in this embodiment, 10 times) to display an image having grey levels.

As described above, it is possible to maximally ensure the light emission period due to the reduction in the number of scan signal supplied to the scan lines. Also, a blank period is included during one frame period. Here, the blank period displays a black color, and therefore the display quality may be improved. The display quality is improved if a subframe displaying a black color is included during one frame period.

In FIG. 2 and Table 1, the data (Data) has 4 bits. However, the data (Data) generally used in the organic light emitting display is set to 8 bits. Accordingly, the case that the data (Data) has 8 bits is described with reference to FIG. 4.

FIG. 4 is a diagram showing a driving method when the data according to the present invention has 8 bits. In FIG. 4, assume that a pixel unit has 320 scan lines. In this case, a time of one frame (1F) is shared into a time of 3200H.

In the following Table 2, an embodiment showing a starting point of each of bit is listed for when the data has 8 bits.

TABLE 2

| | D1 (SF1) | D0 (SF2) | D2 (SF3) | D3 (SF4) | D4 (SF5) | B (SF6) | D7-1 (SF7) | D7-2 (SF8) | D6 (SF9) | D5 (SF10) |
|---|---|---|---|---|---|---|---|---|---|---|
| Starting point | 0 | 22 | 33 | 77 | 165 | 341 | 736 | 1439 | 2144 | 2848 |
| Light emission time | 22H | 11H | 44H | 88H | 176H | 395H | 703H | 705H | 704H | 352H |
| Remainder | 0 | 2 | 3 | 7 | 5 | 1 | 6 | 9 | 4 | 8 |
| Line number | 0 | 318 | 317 | 313 | 304 | 286 | 247 | 177 | 106 | 36 |

Referring to FIG. 4 and Table 2, one frame is divided into 10 subframes. Each of the remaining bits except for an MSB bit among the 8 bits is divided into one subframe period, and the MSB bit is divided into two subframes. That is to say, the MSB bit is divided into a seventh subframe (SF7) and an eighth subframe (SF8). If the MSB bit is divided into two subframes an driven as described above, a difference in the light emission times is lowered when grey levels are displayed, resulting in reduced contour noise. Additionally, a blank frame (B) is included in one frame. Such a blank frame (B) is a period for displaying a black color.

In Table 2, D0 to D7-2 represent positions (or the weights) of the data (Data) according to their bits. That is to say, D0 represents an LSB bit of a data (Data). And, D7-1 and D7-2 represent divided MSB bits. Here, the bits of each of the data (Data) are not sequentially arranged. For example, a D0 bit is arranged prior to a D1 bit. Such an order may be widely varied according to the designer by dividing MSB bits.

The light emission time in each of the bits is set to be doubled compared to the prior bit so as to linearly display grey levels. The bits of D0 emit the light during an 11H period, the bits of D1 emits the light during a 22H period. And, the bits of D2, D3, D4, D5, D6, D7-1 and D7-2 emits the light during periods of 44H, 88H, 176H, 352H, 704H, 703H and 705H, respectively. Here, the sum of the light emission times of the D7-1 bit and the D7 -2 bit is set to a twice value of the D6 bit, namely 1408H. Also, the blank period is determined as 395H from the Equation 1. Here, the blank period may be adjusted by as much as the light emission time (11H) of the LSB bit.

Meanwhile, in the FIG. 4 and Table 2, one frame time is set to 3200H, and the number of subframes is set to 10. And, the starting point of the D1 bit is set to "1." The starting point of the D1 bit is set to "1" rather than "0" because the frame time is set to 3200H.

Figure 5:
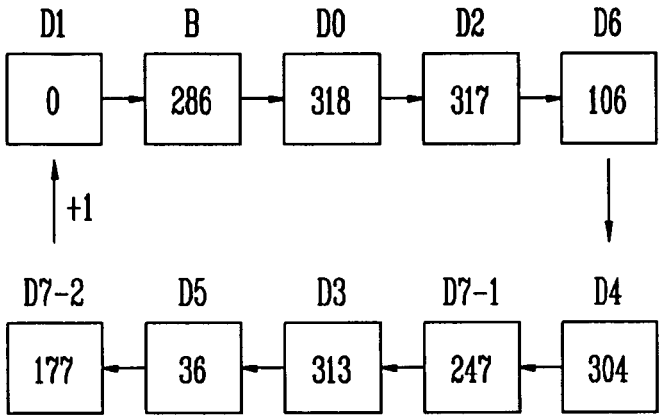
FIG. 5 is a diagram showing the increase in the line number in a driving mode as shown in FIG. 4.

The line numbers of the bits are calculated as 0, 318, 317, 313, 304, 286, 247, 177, 106 and 36, respectively, using the Equation 2. The line numbers obtained thus are arranged according to the size order of the remainders, they are set to an order of 0→286→318→317→106→304→247→313→36→177, as shown in FIG. 5. Here, the weights of the data signal are arranged according to the size order of the remainders in the same manner as the line numbers.

A scan signal is supplied in order of the $0^{th}$ scan line (S0), the $286^{th}$ scan line (S286), the $318^{th}$ scan line (S318), the $317^{th}$ scan line (S317), the $106^{th}$ scan line (S106), the $304^{th}$ scan line (S304), the $247^{th}$ scan line (S247), the $313^{th}$ scan line (S313), the $36^{th}$ scan line (S36) and the $177^{th}$ scan line (S177), according to the line numbers. And, the data signal is supplied to have the weight in order of the remainders listed in the Table 2.

A data signal having the weight of D1 (a light emission period of 22H) is supplied when a scan signal is supplied to the $0^{th}$ scan line (S0). And, a data signal having the weight of a blank period (a light emission period of 395H) is supplied when a scan signal is supplied to the $286^{th}$ scan line (S286). Similarly, data signals having the weights of D0, D2, D6, D4, D7-1, D3, D5 and D7-2 are supplied when a scan signal is sequentially supplied to the $318^{th}$ scan line (S318), the $317^{th}$ scan line (S317), the $106^{th}$ scan line (S106), the $304^{th}$ scan line (S304), the $247^{th}$ scan line (S247), the $313^{th}$ scan line (S313), the $36^{th}$ scan line (S36) and the $177^{th}$ scan line (S177), respectively.

Meanwhile, after the scan signal is supplied to line numbers of the scan lines, the line numbers is increased by 1. Accordingly, the line numbers are arranged in order of 1→287→319→318→107→305→248→314→37→178. In this embodiment, if the increasing line number exceeds 320, it is reset to 0. The procedure is repeated as many as the number of the scan lines to display an image having grey levels.

In such a driving mode, it is possible to reduce a contour noise, because the MSB bit is divided into two subframes and driven. Also, it is possible to maximally ensure the light emission time because the scan signal is supplied to the scan lines at a decreasing number.

Figure 6:
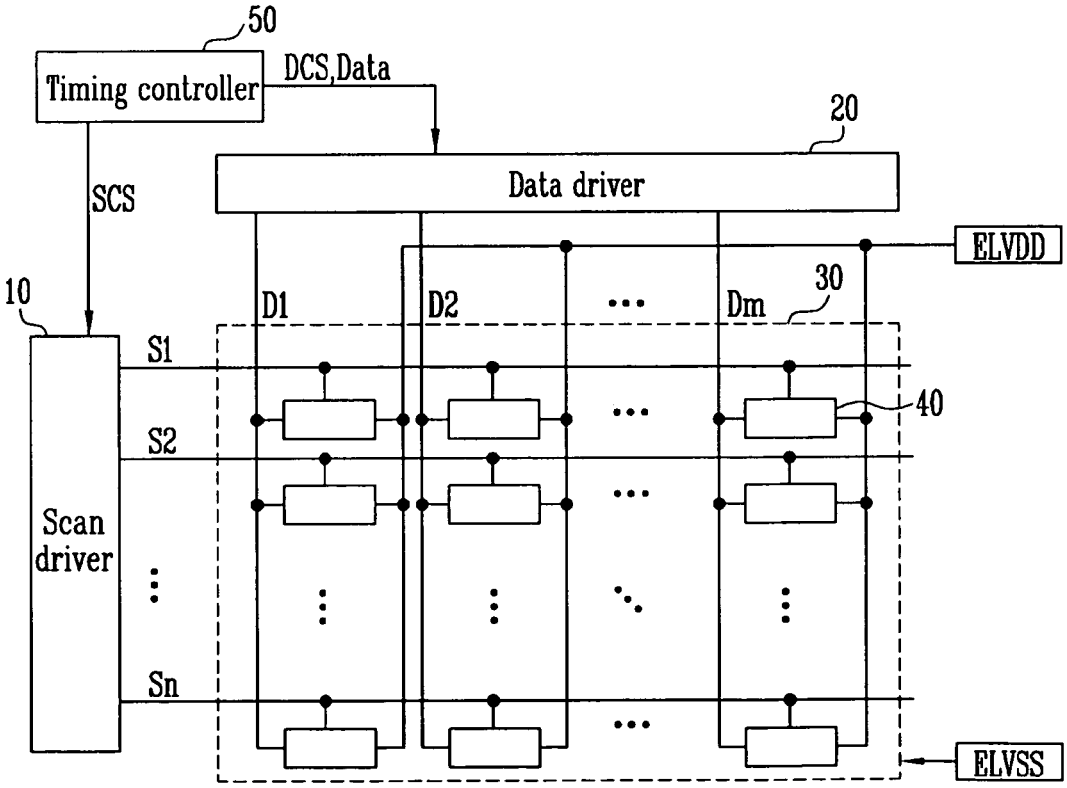
FIG. 6 is a diagram showing an organic light emitting display according to one embodiment.

FIG. 6 is a diagram showing an organic light emitting display.

Referring to FIG. 6, the organic light emitting display according to one embodiment includes a pixel unit 30 including a plurality of pixels 40 coupled to scan lines (S1 to Sn) and data lines (D1 to Dm); a scan driver 10 for driving the scan lines (S1 to Sn); a data driver 20 for driving the data lines (D1 to Dm); and a timing controller 50 for controlling the scan driver 10 and the data driver 20.

The timing controller 50 generates a data drive control signal (DCS) and a scan drive control signal (SCS) to correspond to synchronizing signals received as input. The data drive control signal (DCS) generated in the timing controller 50 is supplied to the data driver 20, and the scan drive control signal (SCS) is supplied to the scan driver 10. Also, the timing controller 50 receives a data (Data), and supplies the received data (Data) to the data driver 20. The timing controller 50 includes a frame memory (not shown).

The data driver 20 converts the data (Data), supplied from the timing controller 50, into a data signal, and supplies the converted data signal to the data lines (D1 to Dm), as shown in FIG. 4. Here, the data signal is divided into a first data signal for allowing the pixel 40 to emit the light; and a second data signal for allowing the pixel 40 not to emit the light.

The scan driver 10 supplies a scan signal to the scan lines (S1 to Sn), as shown in FIG. 4. At this time, the pixels 40 selected by the scan signal receives the first data signal or the second data signal from the data lines (D1 to Dm).

The pixel unit 30 receives a first power source (ELVDD) and a second power source (ELVSS), and supplies the received first power source (ELVDD) and second power source (ELVSS) to each of the pixels 40. Each of the pixels 40 receive the first power source (ELVDD) and the second power source (ELVSS) and receive a first data signal or a second data signal when a scan signal is supplied, and is allowed to emit the light or not to emit the light during each of the subframe periods according to the received data signal.

Figure 7:
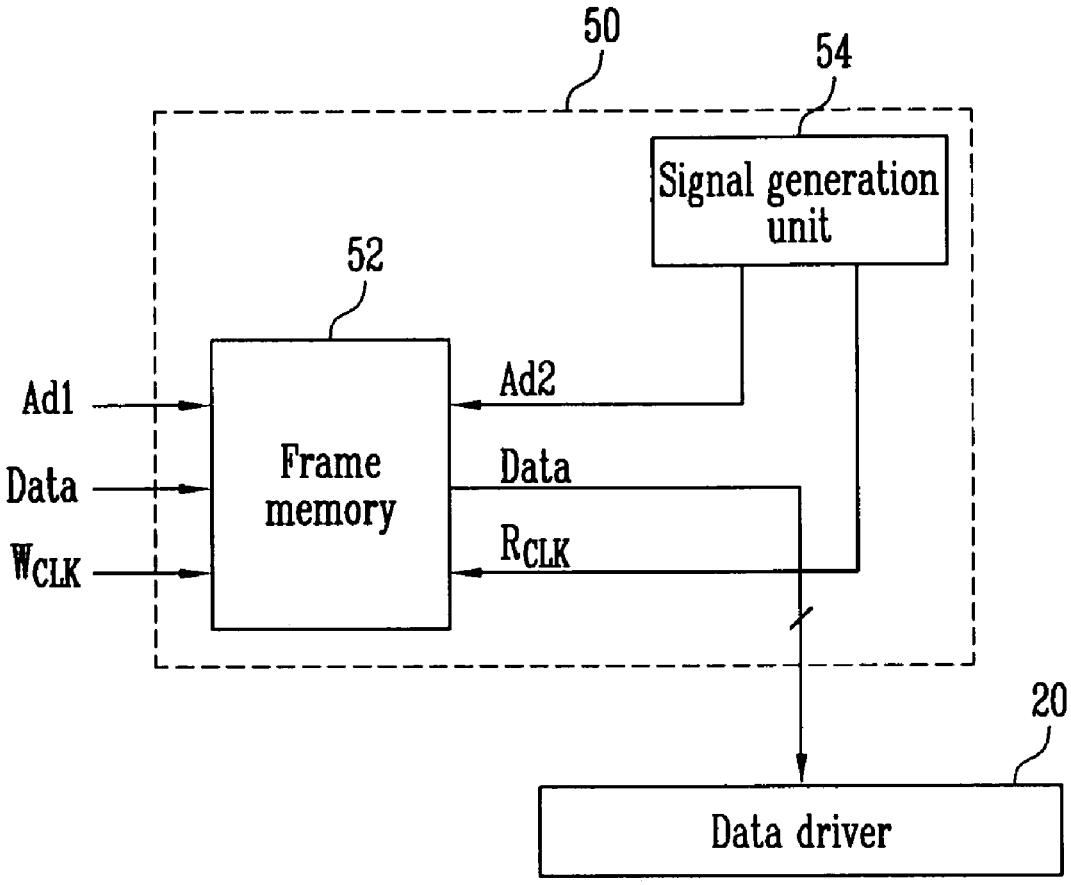
FIG. 7 is a diagram showing a configuration of a timing controller according to one embodiment.

FIG. 7 is a diagram showing a configuration of a timing controller according to one embodiment. With reference to FIG. 7, a procedure of storing a data (Data) and transmitting the stored data to a data driver will be described.

Referring to FIG. 7, the timing controller 50 includes a frame memory 52 for storing a data (Data); and a signal generation unit 54 for supplying control signals to the frame memory 52.

The signal generation unit 54 supplies an address signal (Ad2) and a read clock (RCLK) to the frame memory 52.

The frame memory 52 receives a data (Data) and supplies the received data (Data) to the data driver 20. Here, the frame memory 52 uses a dual port RAM in order to carry out read and write operations independently. The dual port RAM may write a data (Data) and simultaneously read the data (Data).

The frame memory 52 receives an address signal (Ad1), a data (Data) and a write clock (WCLK) from the outside. The frame memory 52 receiving the address signal (Ad1) and the write clock (WCLK) stores the data (Data) in a position assigned in the address signal (Ad1) to correspond to a frequency of the write clock (WCLK).

Also, the frame memory 52 receives an address signal (Ad2) and a read clock (RCLK) from the signal generation unit 54. The address signal (Ad2) supplied from the signal generation unit 54 indicates a position of the data (Data) in the frame memory 52. The frame memory 52 receiving the address signal (Ad2) extracts a data (Data) to correspond to a frequency of the read clock (RCLK), and transmits the extracted data (Data) to the data driver 20.

In the present invention as described above, the read clock (RCLK) may be set to a higher frequency than that of the write clock (WCLK). For example, if the write clock (WCLK) is set to a frequency of 60 Hz, then the read clock (RCLK) may be set to a frequency of 120 Hz. As described above, if the read clock (RCLK) is set to a higher frequency than that of the write clock (WCLK), then a contour noise, a flicker, etc. may be improved. For example, if the read clock (RCLK) has a frequency as twice as the write clock (WCLK), information from 0H to 3199H as shown in FIG. 4 may be displayed twice during one frame period. In this case, an image having improved contour noise and flicker is displayed on the panel.

Furthermore, a PLL (phase lock loop) circuit, or other clock synchronization circuit may be omitted because it is unnecessary to synchronize the write clock (WCLK) with the read clock (RCLK), and therefore complexity of the circuit may reduced and easiness in designs may be also enhanced.

The frame memory 52 is not limited to the driving method as shown in FIG. 4. For example, it is possible to apply to the frame memory 52 in the general digital driving mode.

As described above, the organic light emitting display and the driving method thereof can be useful to improve image quality by setting the read clock of the frame memory to a higher frequency than that of the write clock. Also, the present invention has advantages that a circuit, for example a PPL, for synchronizing the read clock with the write clock is not necessary since the frequency of the read clock is different from the frequency of the write clock, and therefore easiness in designs may be enhanced.

Although exemplary embodiments of the present invention have been shown and described, it would be appreciated by those skilled in the art that changes might be made in these embodiments without departing from the principles and spirit of the invention.

What is claimed is:

1. An organic light emitting display, comprising:

a frame memory configured to store data according to a write clock and to read the stored data according to a read clock;

a signal generation unit configured to supply the read clock to the frame memory;

a data driver configured to convert the data read from the frame memory into a data signal and to supply the converted data signal to data lines;

a scan driver configured to supply a scan signal to scan lines; and a plurality of pixels arranged near crossing points of the scan lines and the data lines, wherein the read clock has a higher frequency than the write clock, and wherein the frame memory is configured to read at least some of the stored data more than once, wherein the scan driver and the data driver are cooperatively configured to display a blank subframe for each scan line, and wherein the light emission time of the blank subframe is substantially equal to:

$$(\text{frame time})-(LSB\ \text{time})\times(2^n-1),$$

wherein (frame time) is equal to the total time of a frame, (LSB time) is equal to the light emission time of an LSB, and n equals the number of bits for each scan line.

2. The organic light emitting display according to claim 1, wherein the frame memory is a dual port RAM.

3. The organic light emitting display according to claim 1, wherein the signal generation unit is further configured to supply an address signal for assigning a memory location of the data that will be read from the frame memory.

4. The organic light emitting display according to claim 1, wherein the scan driver and the data driver are cooperatively configured to supply data to pixels associated with each of a plurality of scan lines, wherein the data for a first scan line is only partially supplied to the first scan line when data for a second scan line begins to be supplied to the second scan line.

5. The organic light emitting display according to claim 1, wherein the scan driver and the data driver are cooperatively configured to supply LSB data and MSB data to the pixels associated with first and second scan lines, wherein the LSB data of the pixels associated with the second scan line is supplied to the second scan line after the LSB data associated with the first scan line is supplied to the first scan line and before the MSB data associated with the first scan line is supplied to the first scan line.

6. The organic light emitting display according to claim 1, wherein the line number for the data to be supplied is equal to:

$$INT\{[(\text{frame time})-(\text{bit starting time}))/(\text{subframe total})]+1\},$$

wherein INT is the integer function, frame time is) is equal to the total time of a frame, bit starting time is equal to the starting time of a bit, and subframe total is the total number of subframes in each frame.

7. A method of driving an organic light emitting display, the method comprising:

storing data in a frame memory according to a write clock;

reading the data stored in the frame memory according to a read clock having a higher frequency than the write clock;

converting the extracted data into a data signal; and supplying the data signal to pixels to generate light having a luminance corresponding to the data signal, wherein at least some of the stored data is read more than once; and displaying a blank subframe for each scan line, wherein the light emission time of the blank subframe is substantially equal to:

$$(\text{frame time})-(LSB\ \text{time})\times(2^n-1),$$

wherein (frame time) is equal to the total time of a frame, (LSB time) is equal to the light emission time of an LSB, and n equals the number of bits for each scan line.

8. The method of driving an organic light emitting display according to claim 7, wherein the frame memory is a dual port RAM.

9. The method of driving an organic light emitting display according to claim 7, further comprising supplying LSB data and MSB data to the pixels associated with first and second scan lines, wherein the LSB data of the pixels associated with the second scan line is supplied to the second scan line after the LSB data associated with the first scan line is supplied to the first scan line and before the MSB data associated with the first scan line is supplied to the first scan line.

10. The method of driving an organic light emitting display according to claim 7, further comprising supplying data to pixels associated with each of a plurality of scan lines, wherein the data for a first scan line is only partially supplied to the first scan line when data for a second scan line begins to be supplied to the second scan line.

11. An organic light emitting display, comprising:

a data driver configured to supply data to data lines;

a scan driver configured to supply a scan signal to scan lines; and a plurality of pixels associated with each of the scan lines, wherein the scan driver and the data driver are cooperatively configured to supply data to the pixels associated with each of the scan lines, wherein the data for a first scan line is only partially supplied to the data lines before data for a second scan line begins to be supplied to the data lines, and wherein at least some of the data is supplied for the first and second scan lines more than one;

wherein the scan driver and the data driver are cooperatively configured to display a blank subframe for each scan line, and wherein the light emission time of the blank subframe is substantially equal to:

$$(\text{frame time})-(LSB\ \text{time})\times(2^n-1),$$

wherein (frame time) is equal to the total time of a frame, (LSB time) is equal to the light emission time of an LSB, and n equals the number of bits for each scan line.

12. The organic light emitting display according to claim 11, further comprising a frame memory configured to store data according to a write clock and to read the stored data according to a read clock.

13. The organic light emitting display according to claim 12, wherein the frame memory is a dual port RAM.

14. The organic light emitting display according to claim 11, wherein the line number for the data to be supplied is equal to:

$$INT\{[((\text{frame time})-(\text{bit starting time}))/(\text{subframe total})]+1\},$$

wherein INT is the integer function, frame time is) is equal to the total time of a frame, bit starting time is equal to the starting, time of a bit, and subframe total is the total number of subframes in each frame.

* * * * *

UNITED STATES PATENT AND TRADEMARK OFFICE

CERTIFICATE OF CORRECTION

PATENT NO. : 8,259,040 B2
APPLICATION NO. : 12/082118
DATED : September 4, 2012
INVENTOR(S) : Do-Hyung Ryu and Do-Ik Kim It is certified that error appears in the above-identified patent and that said Letters Patent is hereby corrected as shown below:

In Column 4, Line 51, please delete "5H+3H." and insert therefore, --5H±3H.--.

In Column 5, Line 21-28, please delete "The line number calculated from the Equation 2 as described above are arranged in order of the size of the remainders, that is, arranged in order of 0 → 6 → 2 → 0 → 9, as shown in FIG. 3. (the size of the remainders is set in order of the first subframe (SF1), the fourth subframe (SF4), the fifth subframe (SF5), the second subframe (SF2) and the third subframe (SF3).) Here, the weight of the data signal is arranged in order of the remainder in the same manner as in the line number." And insert the same on Column 5, Line 21 as a new Paragraph.

In Column 6, Line 44, please delete "D7 -2" and insert therefore, --D7-2--.

In Column 9, Line 51 (Approx.), please delete "is) is" and insert therefore, --is--.

In Column 9, Line 62, please delete "signal; and" and insert therefore, --signal;--.

In Column 10, Line 37, please delete "one;" and insert therefore, --once,--.

In Column 10, Line 60, please delete "is) is" and insert therefore, --is--.

In Column 10, Line 62, please delete "starting," and insert therefore, --starting--.

Signed and Sealed this
Nineteenth Day of February, 2013

Teresa Stanek Rea
*Acting Director of the United States Patent and Trademark Office*